US011541681B2

(12) United States Patent
Vartak

(10) Patent No.: US 11,541,681 B2
(45) Date of Patent: Jan. 3, 2023

(54) INTEGRATED DOCUMENT HOLDER

(71) Applicant: Chintamani Vartak, Pune (IN)

(72) Inventor: Chintamani Vartak, Pune (IN)

( * ) Notice: Subject to any disclaimer, the term of this patent is extended or adjusted under 35 U.S.C. 154(b) by 44 days.

(21) Appl. No.: 17/295,094

(22) PCT Filed: Nov. 14, 2019

(86) PCT No.: PCT/IN2019/050842
§ 371 (c)(1),
(2) Date: May 19, 2021

(87) PCT Pub. No.: WO2020/105065
PCT Pub. Date: May 28, 2020

(65) Prior Publication Data

US 2021/0379922 A1 Dec. 9, 2021

(30) Foreign Application Priority Data

Nov. 20, 2018 (IN) ..... 201821043671

(51) Int. Cl.
*B42F 7/02* (2006.01)

(52) U.S. Cl.
CPC ..... *B42F 7/02* (2013.01); *B42P 2241/02* (2013.01)

(58) Field of Classification Search
CPC .... B42F 7/02; B42P 2241/00; B42P 2241/02; B42P 2241/08; B42P 2201/00
See application file for complete search history.

(56) References Cited

U.S. PATENT DOCUMENTS

| | | | | |
|---|---|---|---|---|
| 1,529,264 | A * | 3/1925 | Mayers | B42F 19/00 229/67.1 |
| 2,206,536 | A * | 7/1940 | McLaren | B65D 27/22 229/84 |
| 6,453,589 | B1 * | 9/2002 | Schwartz | B42F 7/02 281/31 |
| 6,758,336 | B2 * | 7/2004 | Kohana | A45C 13/02 206/307.1 |
| 2009/0189386 | A1 * | 7/2009 | Seiffarth | B42F 7/02 281/31 |
| 2015/0091288 | A1 * | 4/2015 | Fukuda | B65H 39/10 493/320 |

* cited by examiner

*Primary Examiner* — Derek J Battisti
(74) *Attorney, Agent, or Firm* — Clark & Brody LP

(57) ABSTRACT

Disclosed is an integrated document holder that includes an arrangement to accommodate clam stapler binding for important documents. Further, the integrated document holder includes holes punched at predefined locations to be utilized for cotton thread binding, if needed. The integrated document holder includes a pen holder integrated into the filing unit. The integrated document holder includes locking mechanisms that provide added support and security to the documents contained therein. The integrated document holder is biodegradable and recyclable.

19 Claims, 11 Drawing Sheets

INTEGRATED DOCUMENT HOLDER

FIELD OF THE INVENTION

The present invention relates to document holders and more particularly to an integrated document holder having customizable filing features having integration capabilities.

BACKGROUND OF INVENTION

Among the diverse kinds of office supplies accessible, document holders are broadly utilized for conveying various distinctive sorts of papers or reports. One exceptionally regular kind of file organizers are framed of a sheet of hardened material such as paper, card stock, plastic, or mix thereof. These file organizers generally collapsed down to form a front and back cover thereby forming an enclosure to hold and protect object such as papers being contained therein. An ordinary document holder incorporates mere front and back spreads with no extra structure, albeit oftentimes the sheet framing the document holder is designed to make pockets or fortifying edges or edges within surfaces of introduction page, the back cover, or both.

While ordinary organizers of this compose are splendidly satisfactory for carrying securely bound papers like scribbling pads and notepads however such organizers have limitations to hold and secure unbound papers of standard sizes. These prior art organizers are designed such that the unbound papers are secured along their focal overlap line by staples or optionally glued to frame. In the event that multipage delicate records, there are chances that such records may drop out of the document holder. Further, the prior art document holders fail to have proper filing systems that are capable of supporting various binding systems as well as maintaining a neat, clean appearance. Moreover, the existing document holders known in the art are either designed to have notches to facilitate staple binding or have punched holes to provide cotton thread binding however such document holders do not provide both accommodations together. In addition, the prior art document holders are non-bio degradable hence have limitations to stand as an eco-friendly product.

Also, the prior art document holders are not easy to customize and require substantial handling time and efforts to customize any particular file. Such customization is not only expensive but also subject to error.

Accordingly, there is a need for an integrated document holder that overcomes the problems faced with standard document holders thereby providing a neater, more efficient document holder having user-friendly customizable features.

SUMMARY OF THE INVENTION

The present invention provides an integrated document holder formed out of a blank to accommodate an A4 size or an A5 size document therein. The integrated document holder comprises a font cover portion, a back cover portion, and a spine portion. The front cover portion has a leading edge that includes a first slot and a second slot. The first slot and the second slot have a tongue lock section defined there between. The front cover portion has a slot of a predefined configuration and shape. A first crease/fold line is defined between the front cover portion and the spine portion. A second crease/fold line is defined between the back cover portion and the spine portion. The front cover portion includes a plurality of slit portions defined along the first and second crease lines and respectively forming a rectangular opening on the front cover portion. The slit portions respectively have guide marks configured on either side thereof. Each of the slit portions has an uncut portion that defines a tamper lock arrangement. The uncut portion facilitates intactness of the slit portions with the blank during various folding positions of the integrated document holder. The uncut portion is configured to be automatically tampered during first use of the integrated document folder. The front cover portion includes a first pair of holes bilaterally disposed along the central axis. The back cover portion includes a second pair of holes bilaterally disposed along the central axis. The back cover portion includes a third pair of holes defined in proximity to a top edge thereof. The back cover portion includes an extension sleeve connected thereto. The extension sleeve has a locking slit defined therein. A third crease line and a fourth crease line are defined between the extension sleeve and the back cover portion. Each of the slit portions is configured to receive a locking member thereon.

DETAILED DESCRIPTION OF THE INVENTION

The invention described herein is explained using specific disclosures/mechanisms exemplary details for better understanding. However, the invention disclosed can be worked on by a person skilled in the art without the use of these specific disclosures.

References in the specification to "one embodiment" or "an embodiment" means that a particular feature, structure, characteristic, or function described in connection with the embodiment is included in at least one embodiment of the invention. The appearances of the phrase "in one embodiment" in various places in the specification are not necessarily all referring to the same embodiment.

References in the specification to "preferred embodiment" means that a particular feature, structure, characteristic, or function described in detail thereby omitting known constructions and functions for clear description of the present invention.

The present invention is illustrated with reference to the accompanying drawings, throughout which reference numbers indicate corresponding parts in the various figures. These reference numbers are shown in bracket in the following description.

Figure 1:
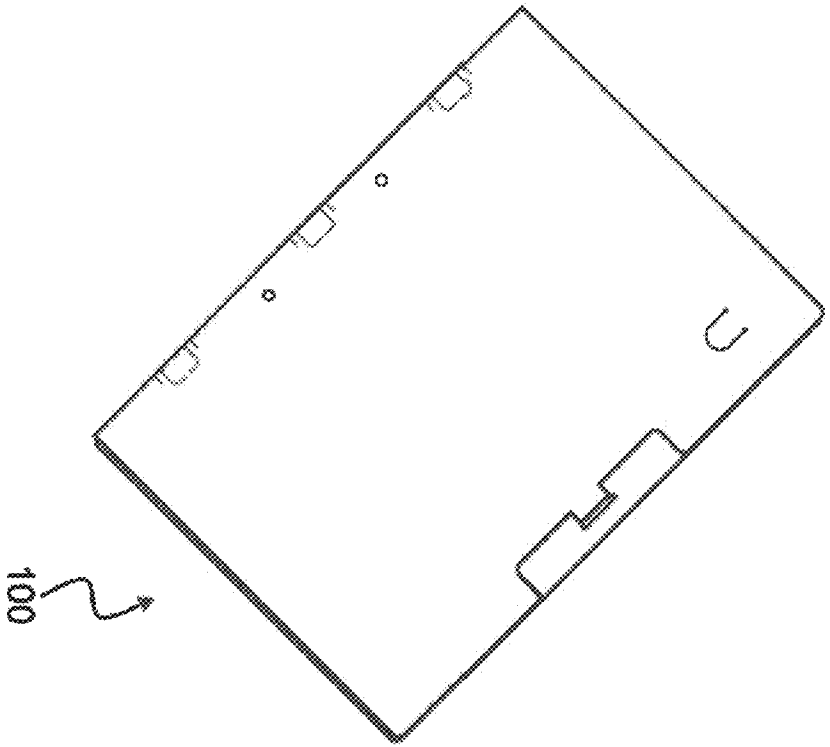
FIG. 1 is a top perspective view of an integrated document holder constructed in accordance with an embodiment of the present invention.

Referring to FIG. 1, an integrated document holder 100 in accordance with an embodiment of the present invention is shown that facilitates an integrated customizable holding system with integration capabilities for different binding systems up to about fifty A4 size pages thereby maintaining a neat and clean appearance. In the context of this embodiment, the integrated document holder 100 is configured to accommodate A4 size document therein however the integrated document holder 100 may be configured to accommodate documents other than A4 size in other alternative embodiments of the present invention. In the context of the present invention, the integrated document holder 100 is made of bio-degradable cardboard or paper material that can be customized to fit user's needs for being advantageously used as an object holder such as a paper holder, a notebook and the like. Accordingly, the integrated document holder 100 is an eco-friendly product that eliminates use of plastic filing folder or docket. However, it is understood here that the integrated document holder 100 may be made of any other material in other alternative embodiments of the present invention.

Figure 2:
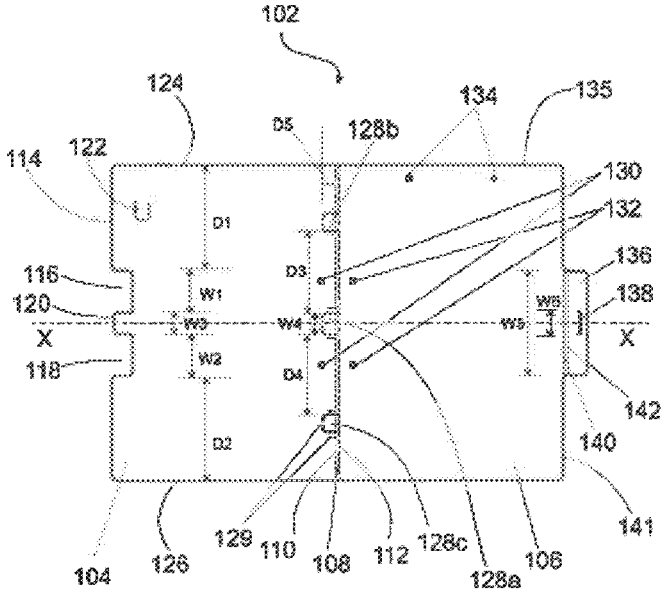
FIG. 2 is a top view of a blank adapted for formation of the integrated document holder of FIG. 1.

Referring to FIGS. 1 and 2, the integrated document holder 100 is formed out of a blank or sheet 102 in accordance with the present invention. The blank 102 includes a front cover portion 104, a back cover portion 106 and a spine portion 108. A first fold or crease line 110 is defined between the front cover portion 104 and the spine 108. A second fold or crease line 112 is defined between the back cover portion 106 and the spine 108. The spine 108 is configured such that the first fold or crease line 110 and the second fold or crease line 112 are spaced apart at a predefined distance.

In the context of the present invention, the predefined distance is at least 1 mm. It is understood here that said predefined distance may vary in various alternative embodiments depending upon the number of pages to be contained within the integrated document holder 100. The front cover portion 104 has a leading edge 114 that defines a first slot 116 and a second slot 118 bilaterally disposed along a central axis X-X such that a tongue lock section 120 is defined there between. The first slot 116 and the second slot 118 have an identical configuration. The first slot 116 is positioned at a distance D1 from a top edge 124 of the front cover portion 104. The second slot 118 is positioned at a distance D2 from a bottom edge 126 of the front cover portion 104. It is understood here that distances D1 and D2 may vary in other alternative embodiments of the present invention. The first slot 116 has a width W1 that is approximately half of the distance D1. The second slot 118 has a width W2 that is approximately half of the distance D2. The tongue lock section 120 has a width W3 that is approximately half of the width W1 and W2. It is understood here that the widths W1, W2, W3 and their dimensional correlation with respect to distances D1, D2 may vary in other alternative embodiments of the present invention. The front cover portion 104 includes an arcuate shaped slot 122 defined along the surface in proximity to the top edge 124 and leading edge 114. The arcuate shaped slot 122 has a predefined configuration to act as an article holder to securely hold a subject, such as for example a pen, at a predefined position within the integrated document holder 100. In this one embodiment, the slot 122 is a U shaped slot however it is understood that the shape and configuration of the slot 122 may vary in other alternative embodiments of the present invention such as for example a round shape, an oval shape, a square shape, a rectangular shape, a triangular shape, a trapezoidal shape and the like, The integrated document holder 100 includes a plurality of slit portions defined on the front cover portion 104 of the blank 102. In this one embodiment, the integrated document holder 100 includes a first slit portion 128*a*, a second slit portion 128*b* and a third slit portion 128*c*. It is understood here that the number of slit portions may vary in other alternative embodiments of the present invention.

Figure 2A:
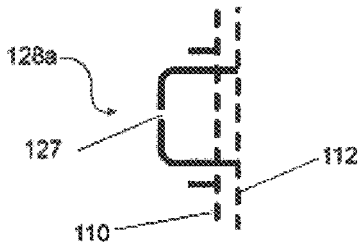
FIG. 2A is an enlarged top view of a first slit portion of the blank of FIG. 2.

As shown in FIG. 2A, each of the slit portions 128*a*, 128*b*, 128*c* have an uncut portion 127 that defines a tamper lock arrangement in accordance with the present invention. The uncut portion 127 facilitates intactness of the slit portions 128*a*, 128*b*, and 128*c* with the blank 102 during various folding positions thereof.

Referring back to FIG. 2, the first slit portion 128*a* is preferably centrally positioned along the center line X-X. In this embodiment, the second slit portion 128*b* is defined at a third distance D3 from the first slit portion 128*a*. The third slit portion 128*c* is defined at a fourth distance D4 from the first slit portion 128*a*. It is understood here that the distances D3 and D4 may vary in other alternative embodiments of the present invention. Each of the slit portions 128*a*, 128*b*, and 128*c* has width W4 that is approximately equal to width W3 of the tongue lock section 120. It is understood here that the width W4 and its dimensional correlation with respect to width W3 may vary in other alternative embodiments of the present invention. Each of the slit portions 128*a*, 128*b* and 128*c* forms a rectangular opening that extends at a predefined distance D5 from the second fold or crease line 112. It is understood here that distance D5 may vary in other alternative embodiments of the present invention. Each of the slit portions 128*a*, 128*b* and 128*c* has guide marks 129 defined on either side thereof. The guide marks 129 are adapted to be guide the user while stapling the papers contained within the integrated document holder 100. Alternatively, the guide marks 129 may also be utilized to define center position for a document while positioning and locking said document within the integrated document holder 100 during use thereof.

The front cover portion 104 includes a first pair of holes 130 bilaterally disposed along the central horizontal axis X-X. The back cover portion 106 includes a second pair of holes 132 bilaterally disposed along the central horizontal axis X-X. The first pair of holes 130 is configured to be aligned with second pair of holes 132 in a closed position of the integrated document holder 100. The back cover portion 106 includes a third pair of holes 134 in proximity to a top edge 135.

The back cover portion 106 includes an extension sleeve 136. The extension sleeve 136 has a rectangular configuration in this one embodiment. However, shape and configuration of the extension sleeve 136 may vary in other alternative embodiments of the present invention. The extension sleeve 136 is adapted to be utilized for labeling the integrated document holder 100 during use thereof. The extension sleeve 136 has a width W5 that is approximately equal to combined width formed by W1, W2 and W3. It is understood here that the width W5 and its dimensional correlation with respect to W1, W2, and W3 may vary in other alternative embodiments of the present invention. The extension sleeve 136 includes a locking slit 138 centrally positioned along the central horizontal axis X-X. The locking slit 138 has a width W6 that is equal to the width W3 of the tongue lock section 120. However, it is understood that the width W6 and its dimensional correlation with respect to width W3 may change in other alternative embodiments of the present invention. The locking slit 138 is configured to receive the tongue lock section 120 therein. A third fold or crease line 140 and a fourth fold or crease line 142 are defined between the extension sleeve 136 and the back cover portion 106. The third fold or crease line 140 is aligned along a trailing edge 141 of the back cover portion 106.

Figure 3:
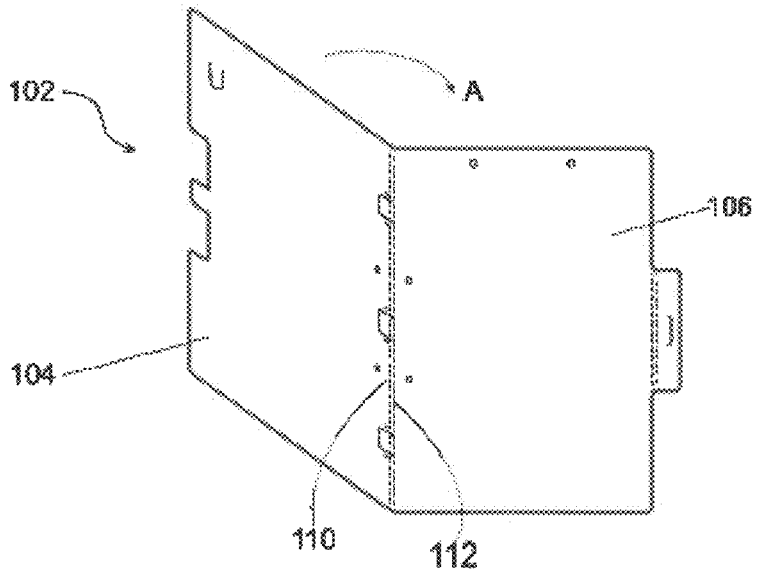
FIG. 3 is a perspective view of the blank in a first folding state during formation of the integrated document holder of FIG. 1.

In the context of the present invention, a stepwise procedure for formation of the integrated document holder 100 from the blank 102 is described hereinafter-Referring to FIG. 3, the front cover portion 104 is folded over the back cover portion 106 along a second crease line 112 in a direction shown by an arrow A. This defines a first folding state of the blank 102. In the first folding state, the front cover portion 104 partially lays over the back cover portion 106.

Figure 4:
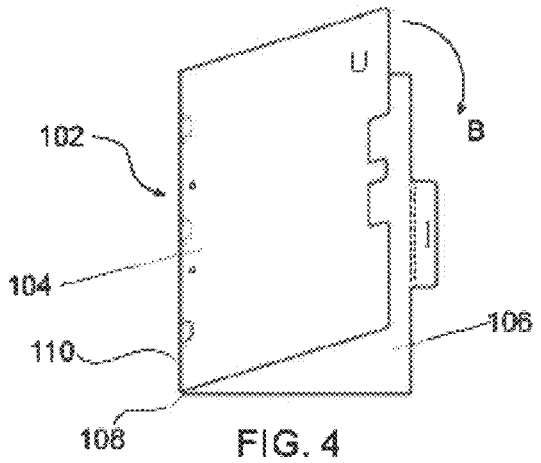
FIG. 4 is a perspective view of the blank in a second folding state during formation of the integrated document holder of FIG. 1.

Referring to FIG. 4, the front cover portion 104 is folded over the back cover portion 106 along the first crease line 110 in a direction show by an arrow B. This defines a second folding state of the blank 102. In the second folding state, the front cover portion 104 totally lays over the back cover portion 106 such that the spine portion 108 is approximately perpendicular to the front cover portion 104 and back cover portion 106.

Figure 5:
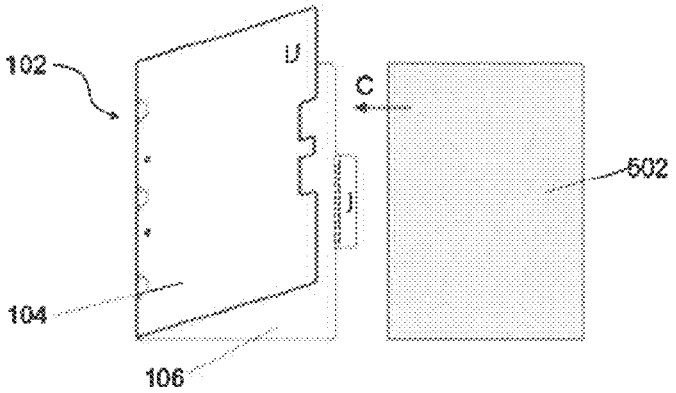
FIG. 5 is a perspective view showing a process of insertion of a document inside the blank during formation of the integrated document holder of FIG. 1 in the second folding state thereof.

As shown in FIG. 5, a document 502 is slid inside an enclosure, formed within the front cover portion 104 and the back cover portion 106, along a direction shown by an arrow C. In this one embodiment, the document 502 is a standard A4 size document. However, it is understood that the documents of other sizes less than A4 size may be positioned in said enclosure formed within the front cover portion 104 and the back cover portion 106.

Figure 6:
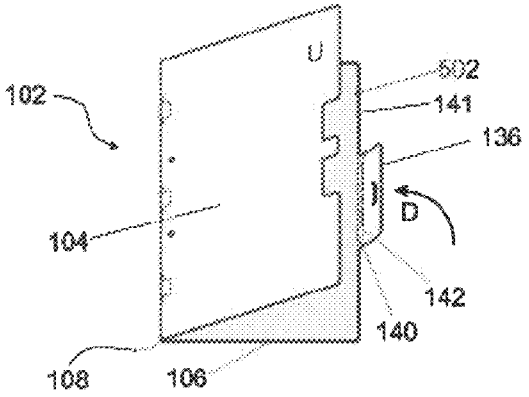
FIG. 6 is a perspective view of the blank in a third folding state during formation of the integrated document holder of FIG. 1.

Referring to FIG. 6, the extension sleeve 136 is folded over the document 502 positioned on the back cover portion 106 along the third crease line 140 in a direction show by an arrow D. This defines a third folding state of the blank 102. In the third folding state, the extension sleeve 136 partially lays over the document 502 thereby aligning the document 502 between the spine 108 and the trailing edge 141 of the back cover portion 106.

Figure 7:
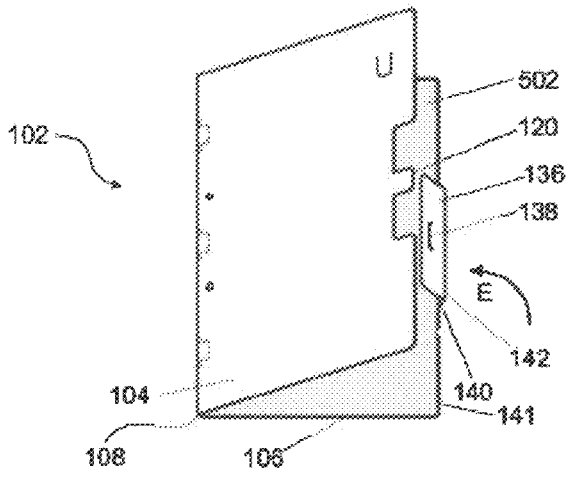
FIG. 7 is a perspective view of the blank in a fourth folding state during formation of the integrated document holder of FIG. 1.

As shown in FIG. 7, the extension sleeve 136 is further folded over the document 502 positioned on the back cover portion 106 along the fourth crease line 142 in a direction show by an arrow E. This defines a fourth folding state of the blank 102. In the fourth folding state, the extension sleeve 136 totally lays over the document 502 thereby securing the document 502 between the spine 108 and the trailing edge 141 of the back cover portion 106. This defines a closed position of the integrated document holder 100.

Figure 8:
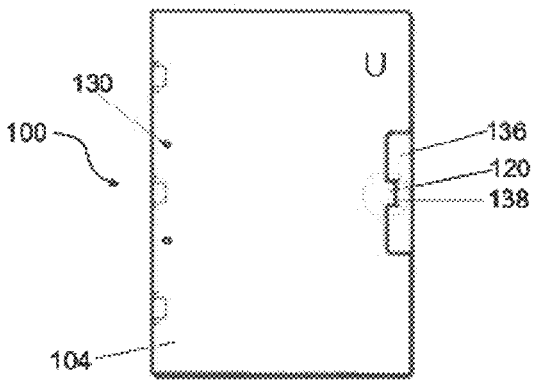
FIG. 8 is a perspective view of the integrated document holder of FIG. 1 showing a first locking arrangement thereof.

Referring to FIGS. 7 and 8, in the fourth folding state of the blank 102, the extension sleeve 136 is positioned over the document 502 such that the tongue lock section 120 slides through the locking slit 138 thereby defining a first locking arrangement of the integrated document holder 100. In this position, the first pair of holes 130 defined on the front cover portion 104 is aligned with second pair of holes 132 of the back cover portion 106 to facilitate tying of cotton thread there through to hold and lock one side of the document 502 within the integrated document holder 100. This defines a second locking arrangement of the integrated document holder 100. Alternatively, the user may optionally utilize the third pair holes 134 (shown in FIG. 2) for tying cotton thread there through to vertically hold and lock the document 502 within the integrated document holder 100. This defines a third locking arrangement of the integrated document holder 100.

Figure 9:
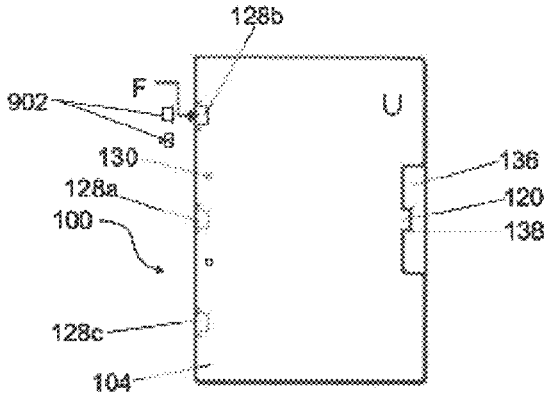
FIG. 9 is a perspective view of the integrated document holder of FIG. 1 showing a second locking arrangement thereof.

As shown in FIG. 9, in the closed position of the integrated document holder 100, the slit portions 128*a*, 128*b* and 128*c* align along the plane of the document 502 such that a locking member 902 is directly positioned on the document 502 along the direction indicated by an arrow F, without the need of positioning the locking member 902 on the front cover portion 104. This defines a fourth locking arrangement of the integrated document holder 100. In addition, the slit portions 128*a*, 128*b* and 128*c* advantageously allow the user to fully uncover the front cover portion 104 without any disturbance or hindrance of the locking member 902. In this position, the uncut portion 127 (as shown in FIG. 2A) is configured to be automatically tampered during first use of the integrated document folder 100, preferably when the user opens the front cover portion 104 for the first time during the use of the integrated document holder 100.

Figure 10:
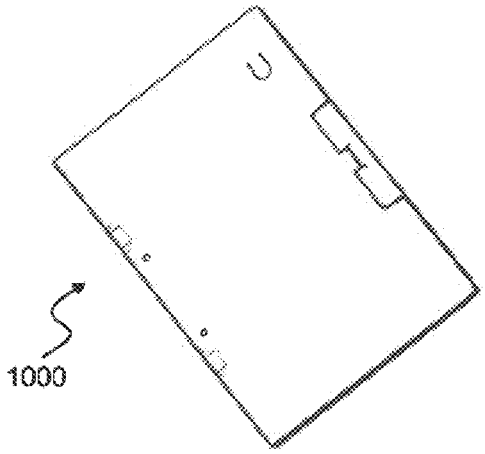
FIG. 10 is a top perspective view of an integrated document holder constructed in accordance with an alternative embodiment of the present invention.

Referring to FIG. 10, an integrated document holder 1000 in accordance with an alternative embodiment of the present invention is shown that facilitates an integrated customizable holding system with integration capabilities for different binding systems up to about fifty A5 size pages thereby maintaining a neat and clean appearance. In the context of this embodiment, the integrated document holder 1000 is configured to accommodate A5 size document therein however the integrated document holder 1000 may be configured to accommodate documents other than A5 size in other alternative embodiments of the present invention. In the context of the present invention, the integrated document holder 1000 is made of bio-degradable cardboard or paper material that can be customized to fit user's need for being advantageously used as an object holder such as a paper holder, a notebook and the like. Accordingly, the integrated document holder 1000 is an eco-friendly product that eliminates use of plastic filing folder or docket. However, it is understood here that the integrated document holder 100 may be made of any other material in other alternative embodiments of the present invention.

Figure 11:
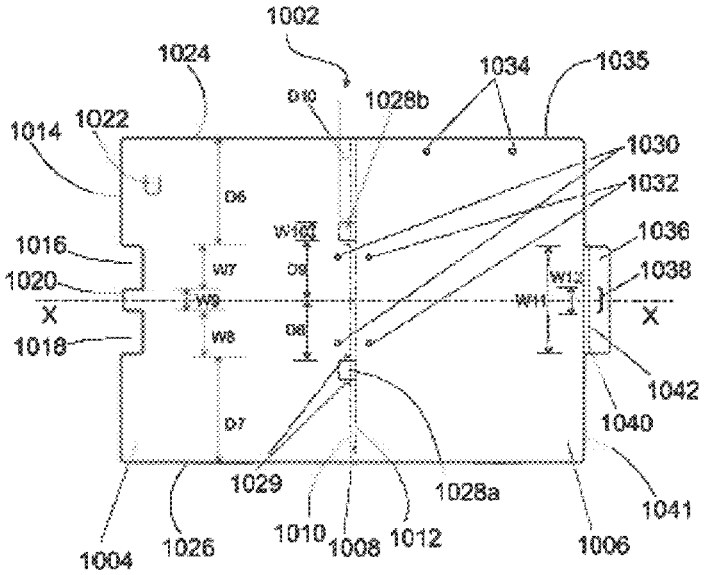
FIG. 11 is a top view of a blank adapted for formation of the integrated document holder of FIG. 10.

Referring to FIGS. 10 and 11, the integrated document holder 1000 is formed out of a blank or sheet 1002 in accordance with the present invention. The blank 1002 includes a front cover portion 1004, a back cover portion 1006 and a spine portion 1008. A first fold or crease line 1010 is defined between the front cover portion 1004 and the spine 1008. A second fold or crease line 1012 is defined between the back cover portion 1006 and the spine 1008. The spine 1008 is configured such that the first fold or crease line 1010 and the second fold or crease line 1012 is spaced apart at a predefined distance. In the context of the present invention, the predefined distance is at least 1 mm. It is understood here that said predefined distance may vary in various alternative embodiments depending upon the number of pages to be contained within the integrated document holder 1000. The front cover portion 1004 has a leading edge 1014 that defines a first slot 1016 and a second slot 1018 bilaterally disposed along a center line X-X such that a tongue lock section 1020 is defined there between. The first slot 1016 and the second slot 1018 have an identical configuration. The first slot 1016 is positioned at a distance D6 from a top edge 1024 of the front cover portion 1004. The second slot 1018 is positioned at a distance D7 from a bottom edge 1026 of the front cover portion 1004. It is understood here that distances D6 and D7 may vary in other alternative embodiments of the present invention. The first slot 1016 has a width W7 that is approximately half of the distance D6. The second slot 1018 has a width W8 that is approximately half of the distance D7. The tongue lock section 1020 has a width W9 that is approximately half of the width W6 and W7. It is understood here that the widths W7, W8, W9 and their dimensional correlation with respect to distances D6, D7 may change in other alternative embodiments of the present invention. The front cover portion 1004 includes an arcuate shaped slot 1022 defined along the surface in proximity to the top edge 1024 and leading edge 1014. The arcuate shaped slot 1022 has a predefined configuration to act as an article holder to securely hold a subject, such as for example a pen, at a predefined position within the integrated document holder 1000. In this one embodiment, the slot 1022 is a U shaped slot however it is understood that the slot 1022 may have other shapes in other alternative embodiments of the present invention such as for example a round shape, an oval shape, a square shape, a rectangular shape, a triangular shape, a trapezoidal shape and the like.

The integrated document holder 1000 includes a plurality of slit portions. In this one alternative embodiment, the integrated document holder 1000 includes a first slit portion 1028*a* and a second slit portion 1028*b*. It is understood here that the number of slit portions may vary in other alternative embodiments of the present invention.

Figure 11A:
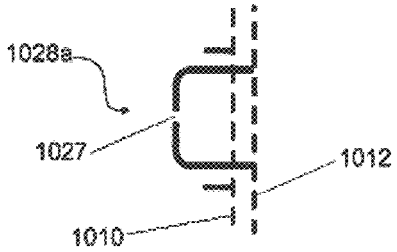
FIG. 11A is an enlarged top view of the first slit portion of the blank of FIG. 11.

As shown in FIG. 11A, each of the slit portions 1028*a*, 1028*b*, 1028*c* have an uncut portion 1027 that defines a tamper lock arrangement in accordance with the present invention. The uncut portion 1027 facilitates intactness of the slit portions 1028*a*, 1028*b*, and 1028*c* with the blank 1002 during various folding positions thereof.

Referring back to FIG. 11, the first slit portion 1028*a* is preferably positioned at a distance D8 from the central axis X-X. The second slit portion 1028*b* is preferably positioned at a distance D9 from the central axis X-X. It is understood here that the distances D8 and D9 may vary in other alternative embodiments of the present invention. Each of the slit portions 1028*a* and 1028*b* has width W10 that is approximately equal to width W9 of the tongue lock section 1020. It is understood here that the width W9 and its dimensional correlation with respect to width W10 may vary in other alternative embodiments of the present invention. Each of the slit portions 1028*a* and 1028*b* forms a rectangular opening that extends at a predefined distance D10 from the second fold or crease line 1012. It is understood here that distance D10 may vary in other alternative embodiments of the present invention. Each of the slit portions 1028*a* and 1028*b* has guide marks 1029 defined on either side thereof. The guide marks 1029 are adapted to assist the user while stapling the papers contained within the integrated document holder 1000. Alternatively, the guide marks 1029 may also be utilized to define center position for a document while positioning and locking said document within the integrated document holder 100 during use thereof.

The front cover portion 1004 includes a first pair of holes 1030 bilaterally disposed along the central horizontal axis X-X. The back cover portion 1006 includes a second pair of holes 1032 bilaterally disposed along the central horizontal axis X-X. The first pair of holes 1030 is configured to be aligned with second pair of holes 1032 in a closed position of the integrated document holder 100. The back cover portion 1006 includes a third pair of holes 1034 in proximity to a top edge 1035.

The back cover portion 1006 includes an extension sleeve 1036. The extension sleeve 1036 has a rectangular configuration in this one embodiment. However, shape of the extension sleeve 136 may vary in other alternative embodiments of the present invention. The extension sleeve 136 is adapted to be utilized for labeling the integrated document holder 100 in a closed position thereof. The extension sleeve 1036 has a width W11 that is approximately equal to combined width formed by W7, W8 and W9. It is understood here that the width W11 and its dimensional correlation with respect to W7, W8, and W9 may vary in other alternative embodiments of the present invention. The extension sleeve 1036 includes a locking slit 1038 centrally positioned along the central horizontal axis X-X. The locking slit 1038 has a width W12 that is equal to the width W9 of the tongue lock section 1020. However, it is understood that the width W12 and its dimensional correlation with respect to width W9 may vary in other alternative embodiments of the present invention. The locking slit 1038 is configured to receive the tongue lock section 1020 therein. A third fold or crease line 1040 and a fourth fold or crease line 1042 are defined between the extension sleeve 1036 and the back cover portion 1006. The third fold or crease line 1040 is aligned along a trailing edge 1041 of the back cover portion 1006.

In the context of the present invention, a stepwise procedure for formation of the integrated document holder 1000 from the blank 1002 is described hereinafter—

Figure 12:
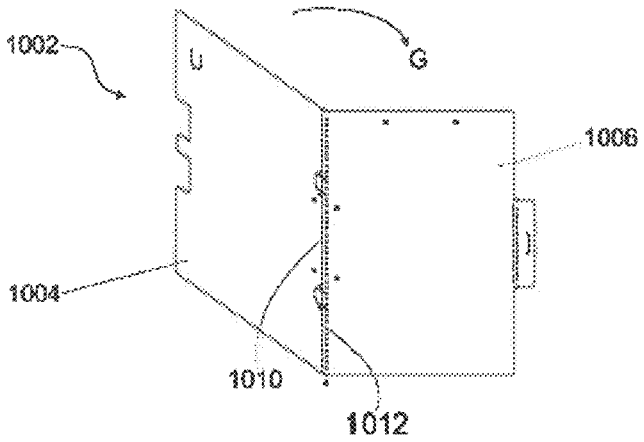
FIG. 12 is a perspective view of the blank in a first folding state during formation of the integrated document holder of FIG. 10.

Referring to FIG. 12, the front cover portion 1004 is folded over the back cover portion 1006 along a second crease line 1012 in a direction shown by an arrow G. This defines a first folding state of the blank 1002. In the first folding state, the front cover portion 1004 partially lays over the back cover portion 1006.

Figure 13:
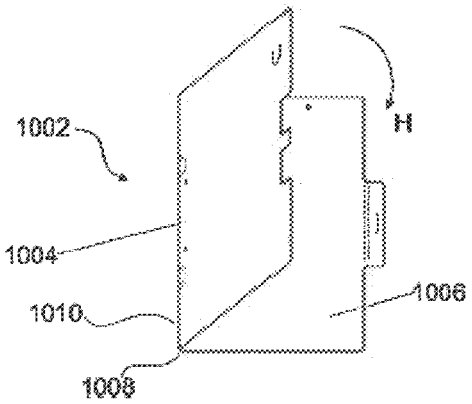
FIG. 13 is a perspective view of the blank in a second folding state during formation of the integrated document holder of FIG. 10.

Referring to FIG. 13, the front cover portion 1004 is folded over the back cover portion 1006 along the first crease line 1010 in a direction show by an arrow H. This defines a second folding state of the blank 1002. In the second folding state, the front cover portion 1004 totally lays over the back cover portion 1006 such that the spine portion 1008 is approximately perpendicular to the front cover portion 1004 and back cover portion 1006.

Figure 14:
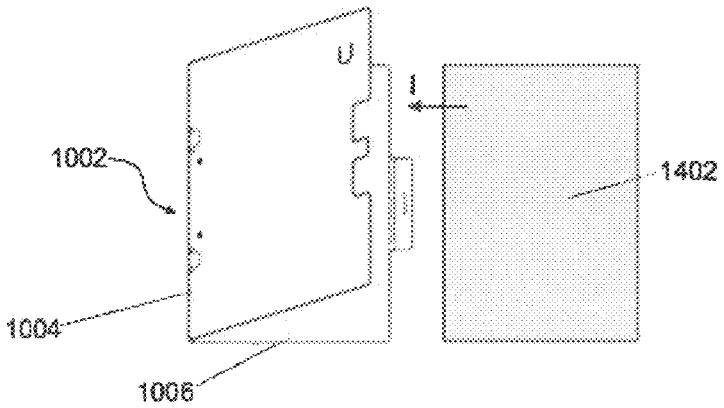
FIG. 14 is a perspective view showing a process of insertion of a document inside the blank during formation of the integrated document holder of FIG. 10 in the second folding state thereof.

As shown in FIG. 14, a document 1402 is slid inside an enclosure formed within the front cover portion 1004 and the back cover portion 1006 in a direction shown by an arrow I. In this one embodiment, the document 1402 is a standard A5 size document. However, it is understood that the documents of other sizes less than A5 size may be positioned in said enclosure formed within the front cover portion 1004 and the back cover portion 1006.

Figure 15:
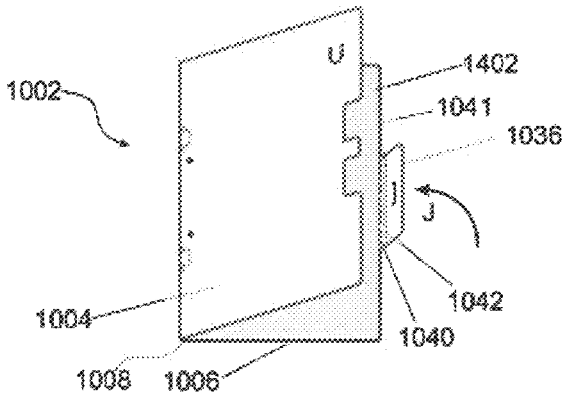
FIG. 15 is a perspective view of the blank in a third folding state during formation of the integrated document holder of FIG. 10.

Referring to FIG. 15, the extension sleeve 1036 is folded over the document 1402 positioned on the back cover portion 1006 along the third crease line 1040 in a direction show by an arrow J. This defines a third folding state of the blank 1002. In the third folding state, the extension sleeve 1036 partially lays over the document 1402 thereby aligning the document 1402 between the spine 1008 and the trailing edge 1041 of the back cover portion 1006.

Figure 16:
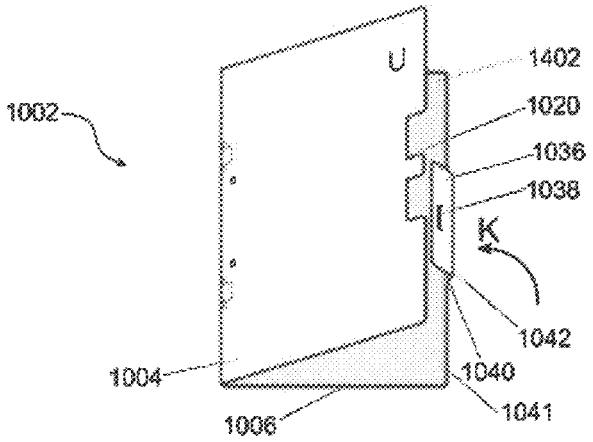
FIG. 16 is a perspective view of the blank in a fourth folding state during formation of the integrated document holder of FIG. 10.

As shown in FIG. 16, the extension sleeve 1036 is further folded over the document 1402 positioned on the back cover portion 1006 along the fourth crease line 1042 in a direction show by an arrow K. This defines a fourth folding state of the blank 1002. In the fourth folding state, the extension sleeve 1036 totally lays over the document 502 thereby securing the document 1402 between the spine 1008 and the trailing edge 1041 of the back cover portion 1006. This defines a closed position of the integrated document holder 1000.

Figure 17:
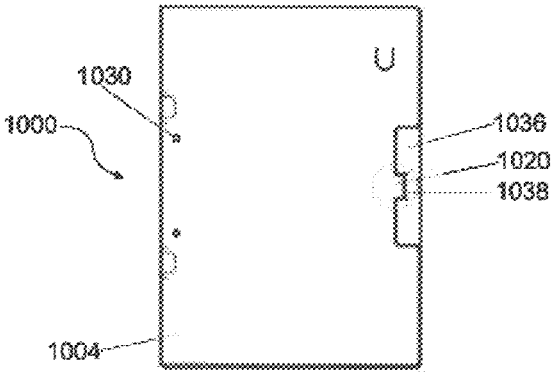
FIG. 17 is a perspective view of the integrated document holder of FIG. 10 showing a first locking arrangement, a second locking arrangement and a third locking arrangement thereof.

Referring to FIGS. 16 and 17, in the fourth folding state of the blank 1002, the extension sleeve 1036 is positioned over the document 1402 such that the tongue lock section 1020 slides through the locking slit 1038 thereby defining a first locking arrangement of the integrated document holder 1000. In this position, the first pair of holes 1030 defined on the front cover portion 1004 is aligned with second pair of holes 1032 of the back cover portion 1006 to facilitate tying of cotton thread there through to hold and lock one side of the document 502 within the integrated document holder 100. This defines a second locking arrangement of the integrated document holder 1000. Alternatively, the user may optionally utilize the third pair holes 1034 (shown in FIG. 11) for tying cotton thread there through to vertically hold and lock the document 502 within the integrated document holder 100. This defines a third locking arrangement of the integrated document holder 1000.

Figure 18:
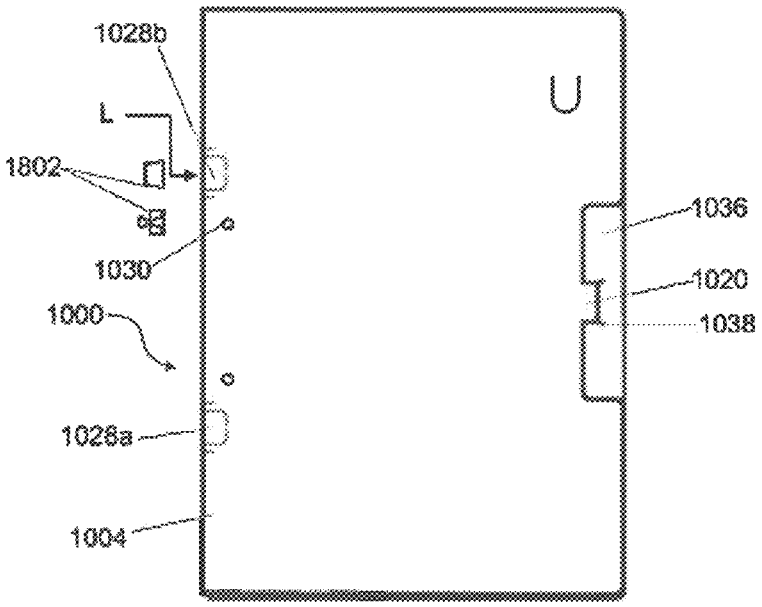
FIG. 18 is a perspective view of the integrated document holder of FIG. 10 showing a fourth locking arrangement thereof.

As shown in FIG. 18, in the closed position of the integrated document holder 1000, the slit portions 1028*a* and 1028*b* align along the plane of the document 1402 such that a locking member 1802 is directly positioned on the document 1402 along a direction shown by an arrow L, without the need of positioning the locking member 1802 on the front cover portion 1004. This defines a fourth locking arrangement of the integrated document holder 1000. In addition, the slit portions 1028*a* and 1028*b* advantageously allow the user to fully uncover the front cover portion 1004 without any disturbance or hindrance of the locking member 1802. In this position, the uncut portion 1027 (as shown in FIG. 2A) is configured to be automatically tampered during first use of the integrated document folder 1000, preferably when the user opens the front cover portion 1004 for the first time during the use of the integrated document holder 1000.

The foregoing description of specific embodiments of the present invention has been presented for purposes of illustration and description. They are not intended to be exhaustive or to limit the present invention to the precise forms disclosed, and obviously many modifications and variations are possible in light of the above teaching.

The embodiments were chosen and described in order to best explain the principles of the present invention and its practical application, to thereby enable others, skilled in the art to best utilize the present invention and various embodiments with various modifications as are suited to the particular use contemplated.

It is understood that various omission and substitutions of equivalents are contemplated as circumstance may suggest or render expedient, but such are intended to cover the application or implementation without departing from the spirit or scope of the present invention.

The invention claimed is:

1. An integrated document holder 100 formed out of a blank 102 to accommodate a document 502 therein, said integrated document holder 100 comprising:

a front cover portion 104, a back cover portion 106 and a spine portion 108, the front cover portion 104 having a leading edge 114, the leading edge 114 including a first slot 116 and a second slot 118, the first slot 116 and the second slot 118 forming a tongue lock section 120 there between, the front cover portion 104 having an arcuate shaped slot 122, the front cover portion 104 and the spine portion 108 having a first crease line 110 defined there between, the back cover portion 106 and spine portion 108 having a second crease line 112 defined there between, the front cover portion 104 having a plurality of slit portions 128*a*, 128*b*, 128*c* defined along the first and second crease lines 110, 112 thereby respectively forming a rectangular opening on the front cover portion 104, each of the slit portions 128*a*, 128*b*, 128*c* having an uncut portion 127 defining a tamper lock arrangement, each slit portions 128*a*, 128*b*, 128*c* respectively having guide marks 129 configured on either sides thereof, the front cover portion 104 having a first pair of holes 130 bilaterally disposed along the central axis, the back cover portion 106 having a second pair of holes 130 bilaterally disposed along the central axis, the back cover portion 106 having a third pair of holes 134 defined in proximity to a top edge 135 thereof, the back cover portion 106 having an extension sleeve 136 connected thereto, the extension sleeve 136 having a locking slit 138 defined therein, the extension sleeve 136 and the back cover portion 106 having a third crease line 140 and a fourth crease line 142 defined therebetween, each of the slit portions 128*a*, 128*b*, 128*c* configured to receive a locking member 902 thereon.

2. The integrated document holder 100 as claimed in claim 1, wherein the front cover portion 104 is folded over the back cover portion 106 along the second crease line 112 to define a first folding state of the blank 104.

3. The integrated document holder 100 as claimed in claim 1, wherein the front cover portion 104 is folded over the back cover portion 106 along the first crease line 110 to define a second folding state of the blank 102.

4. The integrated document holder 100 as claimed in claim 1, wherein the document 502 is slid inside an enclosure formed within the front cover portion 104 and the back cover portion 106 in the second folding state of the blank 102.

5. The integrated document holder 100 as claimed in claim 1, wherein the extension sleeve 136 is folded along the third crease line 140 to define a third folding state of the blank 102.

6. The integrated document holder 100 as claimed in claim 1, wherein the extension sleeve 136 is folded along the fourth crease line 142 to define a fourth folding state of the blank 102.

7. The integrated document holder 100 as claimed in claim 6, wherein the fourth folding state defines a closed position of the integrated document holder 100.

8. The integrated document holder 100 as claimed in claim 6, wherein the fourth folding state is such that the tongue lock section 120 slides through the locking slit 138 thereby defining a first locking arrangement.

9. The integrated document holder 100 as claimed in claim 1, wherein the first pair of holes 130 defined on the front cover portion 104 is aligned with second pair of holes 132 of the back cover portion 106 to facilitate sidewise tying of cotton thread thereby defining a second locking arrangement to hold and lock one side of the document 502 within the integrated document holder 100.

10. The integrated document holder 100 as claimed in claim 1, wherein the third pair holes 134 are optionally utilized for tying cotton thread to vertically hold and lock the document 502 within the integrated document holder 100 thereby defining a third locking arrangement.

11. The integrated document holder 100 as claimed in claim 6, wherein the fourth folding state is such that the slit portions 128*a*, 128*b* and 128*c* receive the locking member 902 thereon to define a fourth locking arrangement.

12. The integrated document holder 100 as claimed in claim 1, wherein the slit portions 128*a*, 128*b* and 128*c* facilitate uncovering of the front cover portion 104 without hindrance to the locking member 902.

13. The integrated document holder 100 as claimed in claim 1, wherein the document 902 is a bunch of A4 or A5 size papers up to fifty pages.

14. The integrated document holder 100 as claimed in claim 1, wherein the slit portions 128*a*, 128*b*, 128*c* have their three slit sides cut from the blank 102 and respectively have a fourth uncut slit along the first and second fold lines 110, 112 to facilitate intactness to the slit portions 128*a*, 128*b*, 128*c*.

15. The integrated document holder 100 as claimed in claim 1, wherein the extension sleeve 136 is adapted to be utilized for labeling the integrated document holder 100.

16. The integrated document holder 100 as claimed in claim 1, wherein the slot 122 has a predefined configuration to securely hold a subject at a predefined position.

17. The integrated document holder 100 as claimed in claim 1, wherein the uncut portion 127 facilitates intactness of the slit portions 128*a*, 128*b*, and 128*c* with the blank 102 during various folding positions of the integrated document holder 100.

18. The integrated document holder 100 as claimed in claim 1, wherein the uncut portion 127 is configured to be automatically tampered during first use of the integrated document folder 100.

19. The integrated document holder 100 as claimed in claim 1, wherein the spine 108 is configured such that the first crease line 110 and the second crease line 112 are spaced apart at a predefined distance of at least 1 mm.

* * * * *